US005620375A

United States Patent [19]

Frotten

[11] Patent Number: 5,620,375

[45] Date of Patent: Apr. 15, 1997

[54] GOLF PUTTING PRACTISE APPARATUS AND METHOD OF INSTALLATION OF THE SAME

[76] Inventor: George N. Frotten, 18437 - 97A Avenue, Edmonton, Alberta, Canada, T5T 3L6

[21] Appl. No.: 617,938

[22] Filed: Mar. 13, 1996

[30] Foreign Application Priority Data

Apr. 5, 1995 [CA] Canada ..... 2146404

[51] Int. Cl.[6] ..... A63B 69/36

[52] U.S. Cl. ..... 473/180

[58] Field of Search ..... 473/180, 139, 473/175, 179, 173, 174, 176–178, 181; 454/289–291

[56] References Cited

U.S. PATENT DOCUMENTS

| | | | |
|---|---|---|---|
| 815,649 | 3/1906 | Smith | 473/180 |
| 969,560 | 9/1910 | O'Neil | 473/139 |
| 5,120,063 | 6/1992 | Birchler et al. | 273/178 R |
| 5,205,559 | 4/1993 | Plopper | 473/179 |
| 5,275,405 | 1/1994 | Ridge | 273/178 R |
| 5,390,917 | 2/1995 | Mendoza | 473/179 |

FOREIGN PATENT DOCUMENTS 51166 4/1983 Canada .

OTHER PUBLICATIONS

Press Release by Wilson Products with respect to Puttacup published Mar. 8, 1983 amd May 1984.

*Primary Examiner*—Mark S. Graham
*Attorney, Agent, or Firm*—Anthony R. Lambert

[57] ABSTRACT

A golf putting practise apparatus having a flat support plate with a peripheral edge. The flat support plate is fabricated of a resilient material that returns to its original shape after bending. A cup depends from the flat support plate. The cup has a peripheral lip which is substantially level with the flat support plate. The golf putting practise apparatus is installed in a floor duct of a forced air heating system by bending the flat support plate and inserting the pepipheral edge of the flat support plate underneath a carpet with the depending cup depending into the floor duct.

4 Claims, 4 Drawing Sheets

GOLF PUTTING PRACTISE APPARATUS AND METHOD OF INSTALLATION OF THE SAME

FIELD OF THE INVENTION

The present invention relates to a golf putting practise apparatus, and in particular, one which is designed to fit into a floor duct of a forced air heating system.

BACKGROUND OF THE INVENTION

U.S. Pat. No. 5,120,063 which issued to Birchler et al in 1992 and U.S. Pat. No. 5,275,405 which issued to Ridge in 1994 both disclose golf practise apparatus which are designed to fit into a floor duct of a forced air heating system. Both apparatus consist of a rigid vent body adapted to fit within the floor duct and having a centrally positioned cup. The Birchler reference has air flow apertures positioned within the cup. The Ridge reference has air flow apertures positioned on either side of the cup with the air directed away from the cup so as not to influence the path of travel of the ball. The Birchler reference relies upon there being peripheral indentations in the carpet when the conventional vent is removed and the golf practise apparatus is substituted. The Ridge reference has a ramp to enable a golf ball rolling along the carpet to climb onto the golf practise apparatus.

It will be understood that while the apparatus, as described, provide a means of practising they have inherent drawbacks, which limit their ability to duplicate conditions that exist on a golf green. On a golf green, if one has the correct weight the ball will arrive at the lip of the cup and drop in. Both the references require the golf ball to leave the carpet and pass along a artificial surface to the cup. To complete a putt on the device as taught by the Ridge reference the ball must climb a ram onto a rigid metal surface. To complete a putt on the device as taught by the Birchler reference, the edge must be sunken into the carpet and the ball must pass over a textured rubber matt. A golf ball hit with what would otherwise be perfect weight can be adversely effected as it leaves the carpet surface.

SUMMARY OF THE INVENTION

What is required is a golf putting practise apparatus, designed to fit into a floor duct of a forced air heating system, with respect to which a golf ball reacts more closely to the manner in which it would on a golf green.

According to one aspect of the present invention there is provided a method of positioning a golf putting practise apparatus into a floor duct of a forced air heating system. Firstly, provide a golf putting practise apparatus having a flat support plate with a peripheral edge. The flat support plate is fabricated of a resilient material that returns to its original shape after bending. A cup depends from the flat support plate. The cup has a peripheral lip which is substantially level with the flat support plate. Secondly, positioning the golf putting practise apparatus in a floor duct of a forced air heating system by bending the flat support plate and inserting the peripheral edge of the flat support plate underneath a carpet with the depending cup depending into the floor duct.

When this method of installation is followed the golf ball literally falls from an edge of the carpet into the cup. This closely resembles the manner in which a golf ball behaves on a golf green. It enables a golfer to more precisely hone his putting skills.

According to another aspect of the present invention there is provided a golf putting practise apparatus designed to fit into a floor duct of a forced air heating system. This golf practise apparatus includes a flat support plate having a first end, a second end and a peripheral edge. The flat support plate is fabricated of a resilient material that returns to its original shape after bending. A cup is spaced from the peripheral edge and depends from the flat support plate. The cup has a peripheral lip which is substantially level with the flat support plate.

The apparatus, as described above, is adapted for use in accordance with the teachings of the method. Although beneficial results may be obtained through the use of the golf putting practise apparatus, as described above, such apparatus has a limited range of approach angles. Even more beneficial results may, therefore, be obtained when the cup is positioned immediately adjacent the first end.

With the cup positioned immediately adjacent one end, the range of approach angles is dramatically increased. Although beneficial result may be obtained through the use of the golf putting practise apparatus, as described above, the positioning of the support plate in the floor duct unavoidably interferes with the operation of the forced air heating system. Even more beneficial results may, therefore, be obtained when the flat support plate has a top surface, a bottom surface and a plurality of air passages are spaced at intervals between the second end and the cup. The air passages extend through the flat support plate from the bottom surface to the top surface.

With air passages provided through the support plate, the forced air heating system can continue to function. Although beneficial results may be obtained through the use of the golf putting practise apparatus, as described above, it is desirable that a golf ball should fall into the cup from anywhere along the carpet adjacent the first end. Even more beneficial results may, therefore, be obtained when the golf cup is substantially oval in shape.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
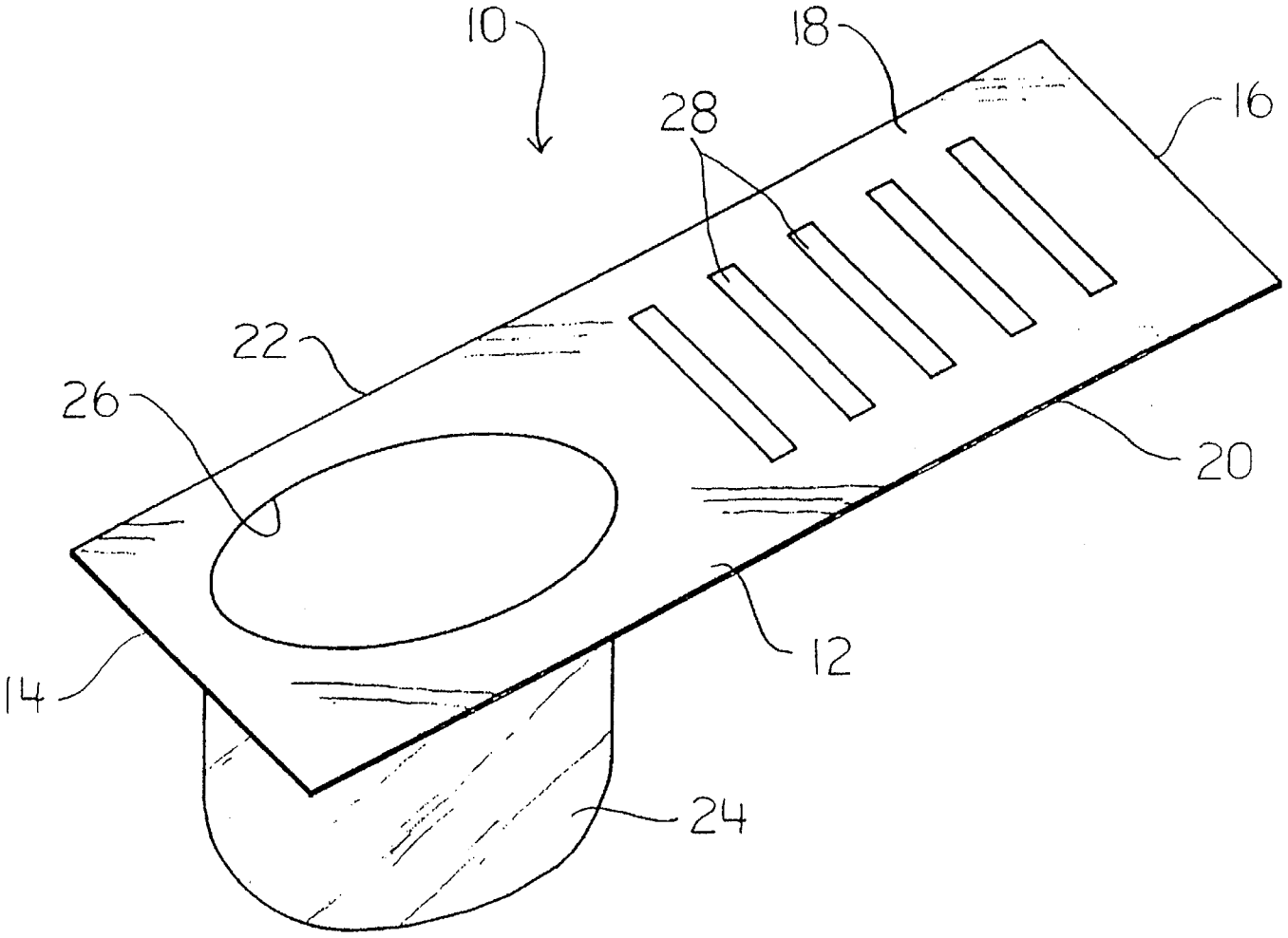
FIG. 1 is perspective view of a golf putting practise apparatus constructed in accordance with the teachings of the present invention.

The preferred embodiment, a golf putting practise apparatus generally identified by reference numeral 10, will now be described with reference to FIGS. 1 through 4.

Referring to FIG. 1, golf putting practise apparatus 10 includes a flat support plate 12 having a first end 14, a second end 16, a top surface 18, a bottom surface 20, and a peripheral edge 22. Flat support plate 12 is fabricated of a resilient material that returns to its original shape after bending; preferably a polymer plastic with suitable elastic recovery. A substantially oval shaped cup 24 is positioned immediately adjacent first end 14. Cup 24 is spaced from peripheral edge 22 for reasons that will become apparent when the method of installation of golf putting practise apparatus 10 is described. Cup 24 has a peripheral lip 26 which is substantially level with top surface 18 of flat support plate 12, with cup 24 depending from flat support plate 12. A plurality of air passages 28 are spaced at intervals between second end 16 and cup 24. Air passages 28 extend through flat support plate 12 from bottom surface 20 to top surface 18.

Figure 2:
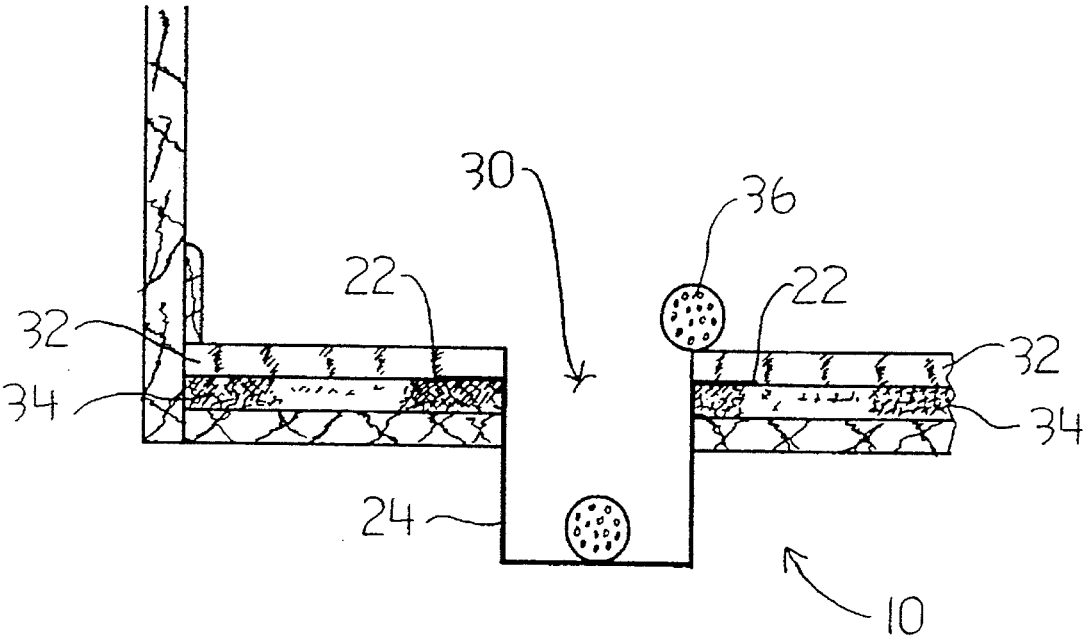
FIG. 2 is an end elevation view in transverse section of the golf putting practise apparatus illustrated in FIG. 1, installed in accordance with the teachings of the preferred method.
Figure 3:
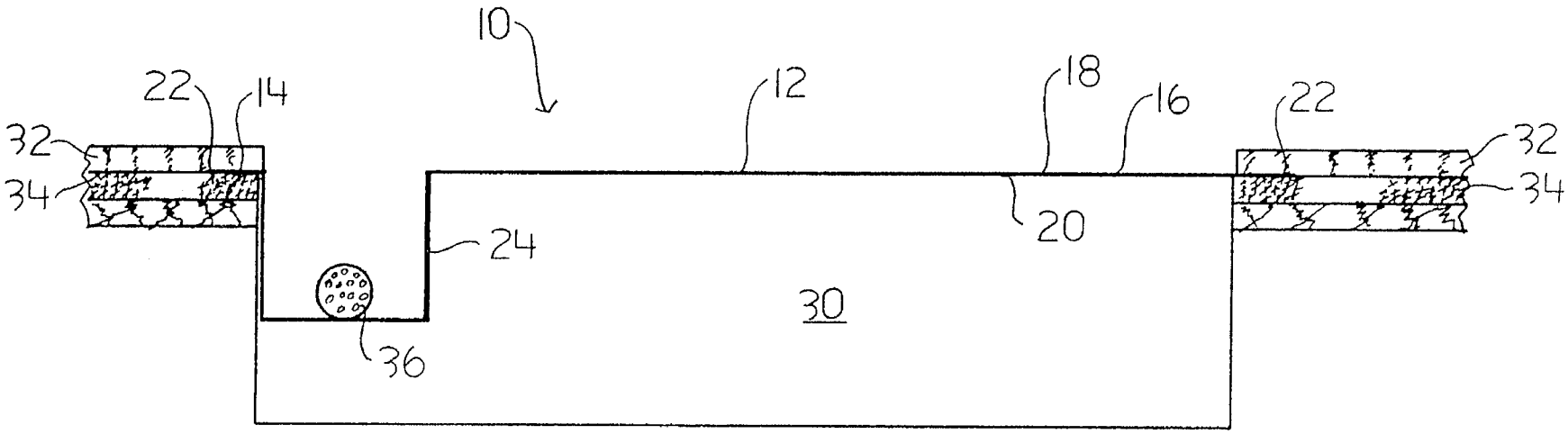
FIG. 3 is a front elevation view in longitudinal section of the golf putting practise apparatus illustrated in FIG. 1, installed in accordance with the teachings of the preferred method.
Figure 4:
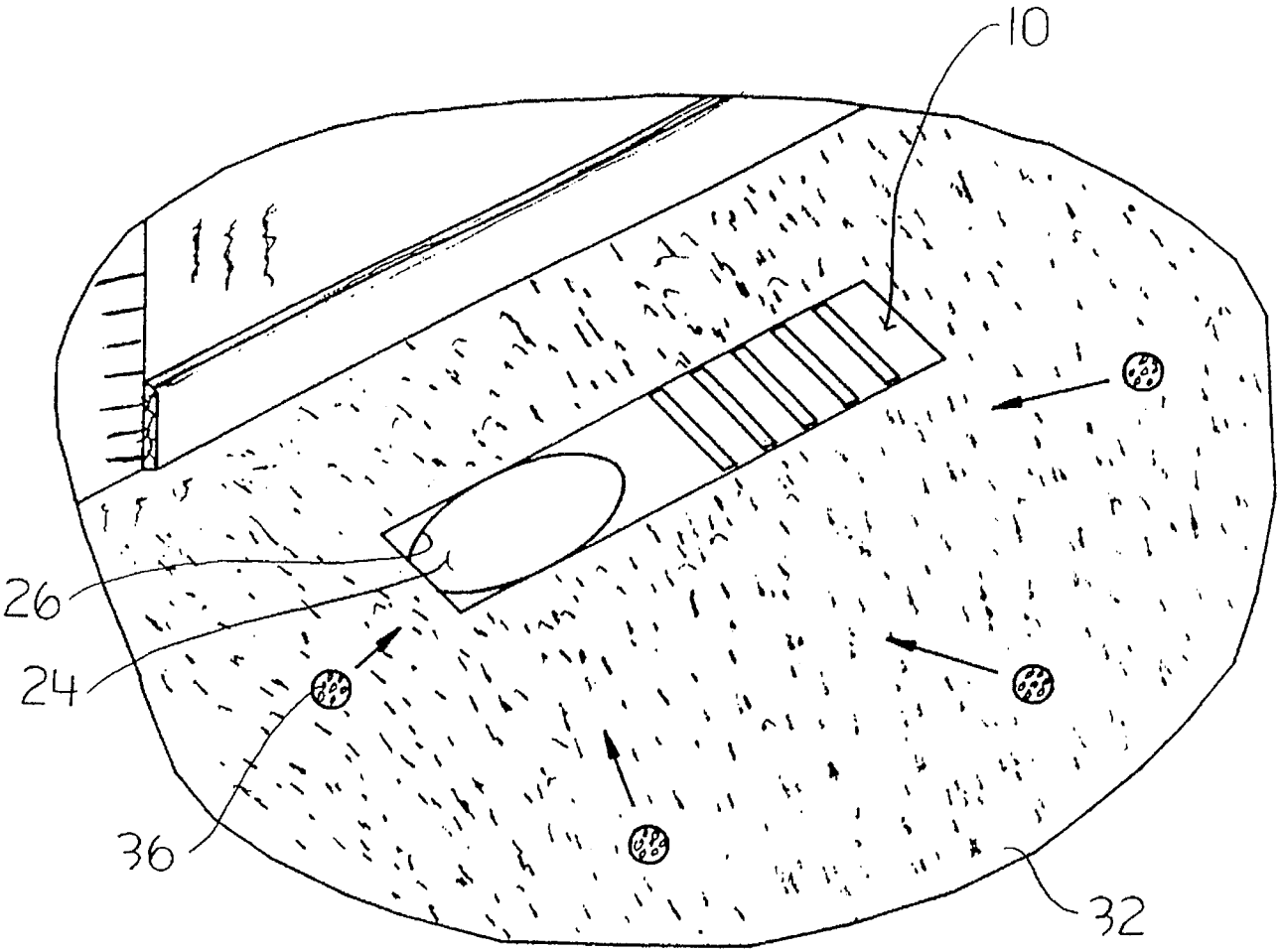
FIG. 4 is a top plan view of the golf putting practise apparatus illustrated in FIG. 1, installed in accordance with the teachings of the preferred method.

The use and operation of golf putting practise apparatus 10 will now be described with reference to FIGS. 1 through 4. Referring to FIGS. 2 and 3, golf putting practise apparatus 10 is positioned in a floor duct 30 of a forced air heating system by bending flat support plate 12 and inserting peripheral edge 22 of flat support plate 12 underneath a carpet 32 between the carpet 32 and subflooring 34. When properly installed cup 24 depends into floor duct 30. Referring to FIG. 4, when installed as described golf putting practise apparatus 10 provides a golfer with a wide range of approach angles from which to practise. It can be seen that oval cup 24 is surrounded on three of four sides by carpet 32. The oval shape also assists in fitting cup 24 into vents of varying sizes, the two most common being a 3 inch width or a 4 inch width. Referring to FIG. 2, a golf ball 36 approaching golf putting practise apparatus 10 falls from carpet 32 into cup 24 in a manner that closely resembles the behaviour of a golf ball on a golf green. A shot will "ride the rim" (peripheral edge 26) and fall into the cup as it would on a golf green.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A golf putting practise apparatus designed to fit into a floor duct of a forced air heating system, comprising:

a flat support plate having a first end, a second end and a peripheral edge, the flat support plate being fabricated of a resilient material that returns to its original shape after bending; and a cup spaced from the peripheral edge immediately adjacent the first end and depending from the flat support plate, the cup having a peripheral lip which is substantially level with the flat support plate; and the flat support plate having a top surface, a bottom surface and a plurality of air passages spaced at intervals between the second end and the cup, the air passages extending through the flat support plate from the bottom surface to the top surface.

2. The golf putting practise apparatus as defined in claim 1, wherein the cup is substantially oval in shape.

3. A golf putting practise apparatus designed to fit into a floor duct of a forced air heating system, comprising:

a flat support plate having a first end, a second end, a top surface, a bottom surface, and a peripheral edge, the flat support plate being fabricated of a resilient polymer plastic material that returns to its original shape after bending;

a substantially oval shaped cup positioned immediately adjacent the first end spaced from the peripheral edge, the cup having a peripheral lip which is substantially level with the flat support plate with the cup depending from the flat support plate; and a plurality of air passages spaced at intervals between the second end and the cup, the air passages extending through the flat support plate from the bottom surface to the top surface.

4. A method of positioning a golf putting practise apparatus into a floor duct of a forced air heating system, comprising the steps of:

firstly, providing a golf putting practise apparatus having a flat support plate with a peripheral edge, the flat support plate being fabricated of a resilient material that returns to its original shape after bending, a cup depending from the flat support plate, the cup having a peripheral lip which is substantially level with the flat support plate; and secondly, positioning the golf putting practise apparatus in a floor duct of a forced air heating system by bending the flat support plate and inserting the peripheral edge of the flat support plate underneath a carpet with the depending cup depending into the floor duct.

* * * * *